US009562414B2

(12) United States Patent
Holderman et al.

(10) Patent No.: US 9,562,414 B2
(45) Date of Patent: Feb. 7, 2017

(54) ISOLATION ASSEMBLY FOR INFLOW CONTROL DEVICE

(75) Inventors: Luke W. Holderman, Plano, TX (US); Travis Thomas Hailey, Jr., Sugar Land, TX (US); Floyd Randolph Simonds, Dallas, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 885 days.

(21) Appl. No.: 13/879,039

(22) PCT Filed: Jun. 29, 2012

(86) PCT No.: PCT/US2012/044824

§ 371 (c)(1), (2), (4) Date: Apr. 12, 2013

(87) PCT Pub. No.: WO2014/003775

PCT Pub. Date: Jan. 3, 2014

(65) Prior Publication Data

US 2014/0000869 A1 Jan. 2, 2014

(51) Int. Cl.

*E21B 43/08* (2006.01)
*E21B 33/127* (2006.01)
(Continued)

(52) U.S. Cl.

CPC ..... *E21B 33/127* (2013.01); *E21B 33/1216* (2013.01); *E21B 34/08* (2013.01); *E21B 43/08* (2013.01); *E21B 43/14* (2013.01)

(58) Field of Classification Search

CPC .... E21B 33/127; E21B 33/1216; E21B 43/14; E21B 43/08; E21B 34/08

See application file for complete search history.

(56) References Cited

U.S. PATENT DOCUMENTS 5,340,626 A * 8/1994 Head ..... E21B 33/1277 166/187
6,112,817 A * 9/2000 Voll ..... E21B 34/08 166/370

(Continued)

FOREIGN PATENT DOCUMENTS

| | | |
|---|---|---|
| CN | 201269089 | 7/2009 |
| CN | 101910553 | 12/2010 |
| WO | 2012021397 | 2/2012 |

OTHER PUBLICATIONS

Australian Application No. 2012383478; Australian Examination Report issued Oct. 9, 2015; 3 pages.

(Continued)

*Primary Examiner* — Robert E Fuller
*Assistant Examiner* — David Carroll
(74) *Attorney, Agent, or Firm* — Kilpatrick Townsend & Stockton LLP

(57) ABSTRACT

Certain aspects and features of the present invention are directed to an isolation assembly that can be disposed in a wellbore through a fluid-producing formation. The isolation assembly can include one joint of a tubing section, at least two inflow control devices, and an isolation element. The joint of the tubing section can include at least two ports. Each inflow control device can be coupled to the tubing section at a respective port. The isolation element can be positioned between the inflow control devices. The isolation element can be configured to fluidly isolate the ports from each other.

20 Claims, 3 Drawing Sheets

(51) Int. Cl.

| | |
|---|---|
| ***E21B 33/12*** | (2006.01) |
| ***E21B 34/08*** | (2006.01) |
| ***E21B 43/14*** | (2006.01) |

(56) References Cited

U.S. PATENT DOCUMENTS

| | | | | |
|---|---|---|---|---|
| 6,186,227 | B1 * | 2/2001 | Vaynshteyn | E21B 33/126 166/120 |
| 7,938,176 | B2 * | 5/2011 | Patel | E21B 33/1216 166/187 |
| 2005/0217849 | A1 * | 10/2005 | Hilsman | E21B 33/12 166/285 |
| 2008/0066900 | A1 | 3/2008 | Saebi et al. | |
| 2008/0164027 | A1 * | 7/2008 | Sanchez | E21B 43/14 166/278 |
| 2010/0038074 | A1 | 2/2010 | Patel et al. | |
| 2011/0073308 | A1 * | 3/2011 | Assal | E21B 43/08 166/278 |
| 2011/0290480 | A1 | 12/2011 | Al-Gouhi et al. | |

OTHER PUBLICATIONS

Singapore Application No. 11201407049V, Office Action mailed on Jun. 4, 2015, 13 pages.

Canadian Patent Application No. 2,877,480 , First Examiner's Letter, mailed Jan. 21, 2016, 3 pages.

Chinese Patent Application No. 201280074376.6, Office Action, mailed Jun. 20, 2016, 25 pages.

* cited by examiner

ISOLATION ASSEMBLY FOR INFLOW CONTROL DEVICE

CROSS-REFERENCE TO RELATED APPLICATIONS

This application is a U.S. national phase patent application under 35 U.S.C. 371 of International Patent Application No. PCT/US2012/044824 entitled "Isolation Assembly for Inflow Control Device" filed Jun. 29, 2012, the entirety of which is incorporated herein by reference.

TECHNICAL FIELD OF THE INVENTION

The present invention relates generally to fluid isolation systems for a well system through a subterranean formation and, more particularly (although not necessarily exclusively), to isolation assemblies for inflow control devices that can isolate different sources of production fluid in producing wells.

BACKGROUND

Various production fluids can be produced via a well traversing a hydrocarbon-bearing subterranean formation. Production fluids from a subterranean formation can include desirable production fluids, such as oil or other hydrocarbons, and undesirable production fluids, such as water. Mature wells in which production has been ongoing for a long duration can include larger amounts of water and other undesirable production fluids than the amounts of desirable production fluid. Producing hydrocarbons in mature wells can thus produce larger amounts of undesirable fluids such as water than producing hydrocarbons from new wells. In addition, a hydrocarbon-bearing formation can include multiple layers of stratification having different permeability characteristics. Differences in permeability at different layers can cause the amount of water in each layer to vary over different strata of a formation through which a wellbore is drilled. In addition, water or other undesirable fluids may have a higher mobility than desirable production fluids and may thus predominate with respect to oil in a subterranean formation.

Current solutions addressing the production of undesirable production fluids can isolate different zones along the wellbore corresponding to different sections of the subterranean formation. Isolation of the zones can reduce the production of undesirable fluid. Such solutions can include fluid discrimination tools, such as inflow control devices deployed in long open hole intervals, such as a horizontal wellbore where the length of the wellbore is much greater than the length of the tool. Such isolation tools deployed in long open hole intervals can be insufficient for isolating strata in other wells where production zones maybe spaced more closely, thereby limiting the space available to isolate each tool from one another.

It is therefore desirable to provide isolation between fluid discrimination devices in a modular and compact manner.

SUMMARY

An isolation assembly is provided that can be disposed in a wellbore through a fluid-producing formation. The isolation assembly can include one joint of a tubing section, at least two inflow control devices, and an isolation element. The joint of the tubing section can include at least two ports. Each inflow control device can be coupled to the tubing section at a respective port. The isolation element can be positioned between the inflow control devices. The isolation element can be configured to fluidly isolate the ports from each other.

These illustrative aspects and features are mentioned not to limit or define the invention, but to provide examples to aid understanding of the inventive concepts disclosed herein. Other aspects, advantages, and features of the present invention will become apparent after review of the entire disclosure and figures.

DETAILED DESCRIPTION

Figure 1:
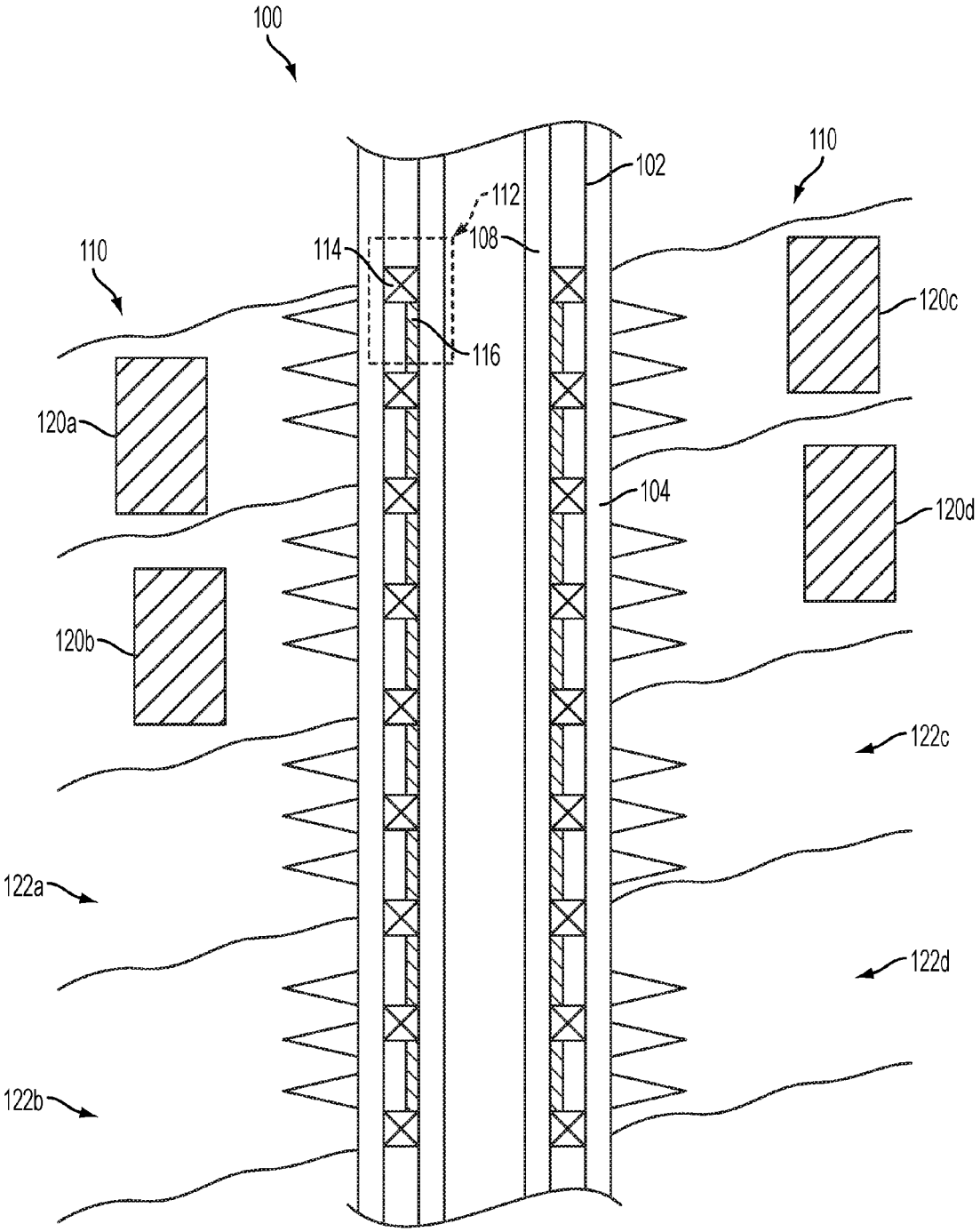
FIG. 1 is a schematic illustration of a well system having isolation assemblies for inflow control devices according to one aspect of the present invention.

Certain aspects and features of the present invention are directed to an isolation assembly for inflow control devices that can be disposed in a wellbore through a fluid-producing formation. The isolation assembly can include short sections between inflow control devices and an isolation element providing an annular barrier between sections. The isolation assembly can include one joint of a tubing section, at least two inflow control devices, and an isolation element. The joint of the tubing section can include at least two ports.

As used herein, the term "joint" can refer to a length of pipe, such as (but not limited to) drill pipe, casing or tubing. One or more joints can form a tubing section of a tubing string. A joint can have any suitable length. Non-limiting examples of lengths of a joint can include five feet, thirty feet, and forty feet.

As used herein, the term "inflow control device" can refer to any device or equipment for controlling the rate of fluid flow from a well for extracting fluids from a subterranean formation. An inflow control device can be used to balance inflow throughout the length of a tubing string of a well system by balancing or equalizing pressure from a wellbore of horizontal well. For example, several inflow control devices disposed at different points along a tubing string of a well can be used to regulate the pressure at different locations in the tubing string. A flow control device otherwise used for inflow control can also be used to stimulate production of fluid from a well. For example, a flow control device can be used to inject fluid into the wellbore to stimulate the flow of production fluids, such as petroleum oil hydrocarbons, from a subterranean formation. Such a device can function as an outflow control device and can be referred to as an inflow control device.

Each inflow control device can be coupled to the tubing section at a respective port. The inflow control devices can be coupled to the tubing section via bushings with tapered threads. The inflow control device and bushing can be threaded directly into the tubing string by threading the inflow control device and bushing onto a threaded end of a tubing section.

The isolation element can be positioned between the inflow control devices. The isolation element can be configured to fluidly isolate the ports from each other. Isolating the two ports from each other can include preventing production fluid flowing into the wellbore from a first portion of a subterranean formation adjacent to a first inflow control device from flowing to a second portion of the wellbore adjacent to a second inflow control device.

A non-limiting example of an isolation element is a swellable rubber element that can swell in response to hydrocarbon exposure in the wellbore. Another non-limiting example of an isolation element is a mechanical isolation element, such as a packer. Another non-limiting example of an isolation element is a chemical isolation element, such as an epoxy or other chemical compound adapted to expand in response to pressure from or contact with hydrocarbons or other production fluids in a wellbore.

Each section of the wellbore can include one or more inflow control devices isolated from one or more adjacent inflow control devices. As water or other undesirable fluids are produced from a section of the subterranean formation, each isolated inflow control device or group of inflow control devices can restrict the flow of water or other undesirable production fluid. In some aspects, such restriction can be performed autonomously by an autonomous inflow control device, thereby allowing sections of the subterranean formation in which water is not being produced to continue to produce freely.

The isolation assembly can reduce the production of water or other undesirable fluid from a subterranean formation by a well system, thereby increasing the amount of oil or other desired hydrocarbons produced from a subterranean formation as compared to the amount of undesirable fluids produced. For example, for a well system in which the amount of undesirable fluid produced is lowered by 10-20%, production of desirable fluid can be increased and resources devoted to separating desirable production fluid from undesirable production fluid can be reduced.

In additional or alternative aspects, the inflow control devices can be autonomous inflow control devices. An autonomous inflow control device can discriminate desirable production fluid from undesirable production fluid without intervention from an operator. Autonomously discriminating desirable production fluid from undesirable production fluid can allow the inflow control device to adjust to changing proportions of desirable production fluid and undesirable production fluid in a subterranean formation over time. Autonomously discriminating desirable production fluid from undesirable production fluid can also allow the inflow control device to apply a different degree of restriction to undesirable fluids than is applied to desirable fluids.

In additional or alternative aspects, the isolation assembly can include one or more filtering elements. Each filtering element can be coupled to the tubing section at or near a respective inflow control device. A filtering element can reduce or prevent particulate material from flowing into the inner diameter of a tubing section via an inflow control device. A non-limiting example of a filtering element is a sand screen coupled to sections of a tubing string of a well system. A sand screen can filter particulate material from production fluid by allowing the production fluid to flow through the sand screen and by preventing particulate material in the production fluid from passing through the sand screen. One example of a sand screen is a wire wrapped helically around a perforated piece of pipe. The helically wrapped wire is spaced and/or gauged based on the size of the particles to be filtered. Another example of a sand screen is a mesh filter. A mesh filter can include a group of fibers or other materials that are woven perpendicularly to another group of fibers or other materials, thereby forming pores allowing the flow of fluid through the mesh filter. Another non-limiting example of a filtering element is a porous medium. The porous medium can be a material having one or more pores adapted to allow a fluid to flow through the porous medium and to prevent one or more particles from flowing through the porous medium.

An end ring can be coupled to each end of the outer diameter of the filtering element. Coupling the end ring can include, for example, crimping the end ring onto the tubing section or shrinking the end ring onto the tubing section via heating and cooling.

In additional or alternative aspects, the isolation element can include an extrusion prevention mechanism. The extrusion prevention mechanism can apply a force to an isolation element, thereby preventing the isolation element from expanding axially. Axial expansion of the isolation element can obstruct, damage, or otherwise interfere with the operation of the inflow control devices and or the filtering elements. Non-limiting examples of an extrusion prevention mechanism can include a bonded steel ring or a metal protrusion of the end rings.

In additional or alternative aspects, multiple isolation assemblies can be coupled to a tubing string, thereby creating a cost-effective joint that can be installed into a wellbore of a subterranean formation.

These illustrative examples are given to introduce the reader to the general subject matter discussed here and are not intended to limit the scope of the disclosed concepts. The following sections describe various additional aspects and examples with reference to the drawings in which like numerals indicate like elements, and directional descriptions are used to describe the illustrative aspects. The following sections use directional descriptions such as "above," "below," "upper," "lower," "upward," "downward," "left," "right," "uphole," "downhole," etc. in relation to the illustrative aspects as they are depicted in the figures, the upward direction being toward the top of the corresponding figure and the downward direction being toward the bottom of the corresponding figure, the uphole direction being toward the surface of the well and the downhole direction being toward the toe of the well. Like the illustrative aspects, the numerals and directional descriptions included in the following sections should not be used to limit the present invention.

FIG. 1 schematically depicts part of a well system 100 having a tubing string 108 with isolation assemblies, such as the isolation assembly 112, according to certain aspects. The well system 100 includes a bore that is a wellbore 102 extending through various earth strata. The wellbore 102 may include a tubing string 108 cemented at an upper portion of the substantially vertical section 104.

The substantially vertical section 104 extends through a hydrocarbon bearing subterranean formation 110. The tubing string 108 within wellbore 102 extends from the surface to the subterranean formation 110.

The subterranean formation 110 includes strata 120*a-d* and strata 122*a-d*. The strata 120*a-d* can store desirable production fluid, such as oil or other hydrocarbons, as depicted by the cross-hatching within the strata 120*a-d*. The strata 122*a-d* can store undesirable production fluid, such as water.

The tubing string 108 can provide a conduit for formation fluids, such as production fluids produced from the subterranean formation 110, to travel from the substantially vertical section 104 to the surface. Pressure from a bore in a subterranean formation can cause formation fluids, including production fluids such as gas or petroleum, to flow to the surface.

The well system 100 can also include one or more isolation assemblies, such as isolation assembly 112. Any number of isolation assemblies can be used within a tubing string 108. Each isolation assembly 112 can be coupled to a tubing section the tubing string 108. Each isolation assembly 112 can include an isolation element 114 and an inflow control device assembly 116. The isolation element can provide isolation between strata 120*a-d* and strata 122*a-d*. The inflow control device assembly 116 can include two or more inflow control devices configured to discriminate oil and other desirable production fluids from water and other undesirable production fluids.

Although FIG. 1 depicts the isolation assemblies 112 positioned in a substantially vertical section 104, any of one or more isolation assemblies can be located, additionally or alternatively, in a substantially horizontal section of a wellbore. Isolation assemblies can be disposed in cased wells, such as is depicted in FIG. 1, or in open hole environments. Isolation assemblies can be disposed in well systems having other configurations including horizontal wells, deviated wells, slanted wells, multilateral wells, etc.

Figure 2:
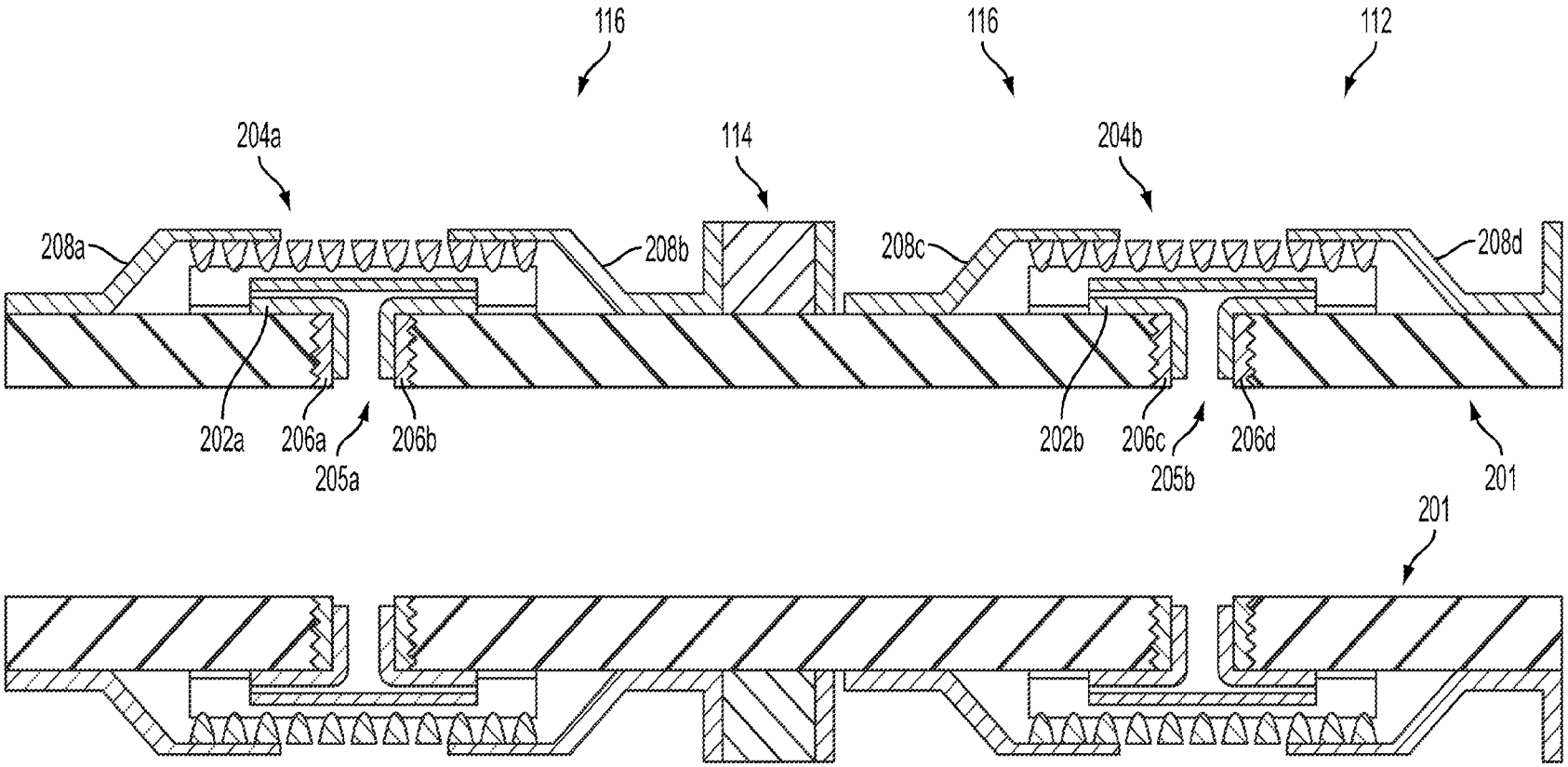
FIG. 2 is a longitudinal cross-sectional view of a section of a tubing string having an isolation assembly for inflow control devices according to one aspect of the present invention.

FIG. 2 depicts a longitudinal cross-sectional view of a joint 201 of a tubing string 108 having an isolation assembly 112. The isolation assembly 112 can include the isolation element 114 and the inflow control device assembly 116. The inflow control device assembly 116 can include the inflow control devices 202*a*, 202*b* and the filtering elements 204*a*, 204*b*.

Each of the inflow control devices 202*a*, 202*b* can discriminate undesirable production fluid from desirable production fluid flowing from the subterranean formation 110 through the ports 205*a*, 205*b* into the inner diameter of the joint 201.

The inflow control devices can be positioned at multiple points of a joint 201. The inflow control devices 202*a*, 202*b* can be coupled to the joint 201 via any suitable mechanism. The inflow devices 202*a*, 202*b*, can be positioned internal or external to the outer surface of the joint 201. The non-limiting example of FIG. 2 depicts the inflow control devices 202*a*, 202*b* coupled to the joint 201 via the bushings 206*a-d*. The inflow control device 202*a* can be threaded into the bushings 206*a*, 206*b*. The inflow control device 202*b* can be threaded into the bushings 206*c*, 206*d*. The bushings 206*a-d* can be respectively coupled to a threaded portion of each of ports 205*a*, 205*b*. Other aspects can include threading or otherwise coupling the inflow control devices 202*a*, 202*b* to a metal plate. The metal plate can be coupled to the joint 201 by, for example, welding the plate to one or more openings in the side wall of the joint 201.

In some aspects, the inflow control devices 202*a*, 202*b* can be more restrictive to an undesirable production fluid than to a desirable production fluid. The difference in restriction of undesirable production fluid and desirable production fluid can discriminate the undesirable production fluid from the desirable production fluid. Discriminating the undesirable production fluid from the desirable production fluid can allow desirable production fluid to be produced from the formation 110 and reduce or prevent the production of undesirable production fluid from the formation 110. In additional or alternative aspects, each of the inflow control devices 202*a*, 202*b* can be an autonomous inflow control device. An inflow control device can be formed from any suitable material, such as (but not limited to) tungsten carbide.

The filtering elements 204*a*, 204*b* can respectively provide filtration for the ports 205*a*, 205*b* of the joint 201. Each of the filtering elements 204*a*, 204*b* can be coupled to the joint 201 at or near the inflow control devices 202*a*, 202*b*. In some aspects, the filtering elements 204*a*, 204*b*, can circumferentially surround the joint 201. The filtering elements 204*a*, 204*b* can prevent particulate matter from entering the inflow control devices 202*a*, 202*b*. In other aspects, the filtering elements 204*a*, 204*b* can be disposed within the inner diameter of the joint 201. Non-limiting examples of the filtering elements 204*a*, 204*b* can include a wire wrap screen, a mesh screen, a porous media with a predetermined porosity configured to prevent particulate matter of a size greater than a predetermined size from passing through the porous medium, etc.

The filtering elements 204*a*, 204*b* can be coupled to the tubing section or otherwise secured in a stable position via any suitable mechanism. FIG. 2 depicts the filtering element 204*a* coupled to the joint 201 via the end rings 208*a*, 208*b* and the filtering element 204*b* coupled to the joint 201 via the end rings 208*c*, 208*d*. Each end ring can be secured to the joint 201 via any suitable mechanism or process. A non-limiting example of securing each end ring to the joint 201 is crimping the end rings. The end ring can be compressed by a force from a compression tool, such as a vice, or an impact tool, such as a hammer.

The isolation element 114 can include any device, mechanism, compound, etc. suitable for providing an annular barrier between the inflow control devices 202*a*, 202*b*. An annular barrier between the inflow control devices 202*a*, 202*b* can prevent or reduce the flow of production fluid from a first portion of the subterranean formation 110 adjacent to the inflow control device 202*a* to a second portion of the subterranean formation 110 adjacent to the inflow control device 202*a*, and vice versa.

An isolation element can include any material or device suitable for forming an annular barrier between isolation assemblies such that production fluid is isolated between ports or other inflow points. Examples of material for forming an isolation element 114 can include (but are not limited to) a swellable element such as rubber, a chemical compound, a mechanical isolation element, an inflatable isolation element, etc. A non-limiting example of a chemical isolation element can be an epoxy injected in a gap between the end rings 208*b*, 208*c* along the outer diameter of the joint 201. A non-limiting example of a mechanical isolation element is a packer. A packer can include an element that can be inserted between the end rings 208*b*, 208*c*, such as an expandable elastomeric element or a flexible elastomeric element such as a packer cup, to create a hydraulic seal. Any number of packers, including one, can be used as an isolation element 114. A non-limiting example of an inflatable isolation element is an inflatable bladder.

A joint 201 can have any length suitable for installation in a tubing string 108. One non-limiting example can include a joint length of five feet. Another non-limiting example can include a joint length of forty feet.

Multiple ports or other inflow points can be included between two connection points of a joint 201. Multiple ports or other inflow points included in a joint 201 can be individually isolated.

Although FIG. 2 depicts a single inflow control device on each side of an isolation element, multiple inflow control devices can additionally or alternatively be included between two isolation elements.

In additional or alternative aspects, the isolation element can include an extrusion prevention mechanism. The extrusion prevention mechanism can apply a force to an isolation element, thereby preventing the isolation element from expanding axially. Axial expansion of the isolation element can obstruct, damage, or otherwise interfere with the operation of the inflow control devices and or the filtering elements. Non-limiting examples of an extrusion prevention mechanism can include a bonded steel ring or a metal protrusion of the end rings.

Figure 3:
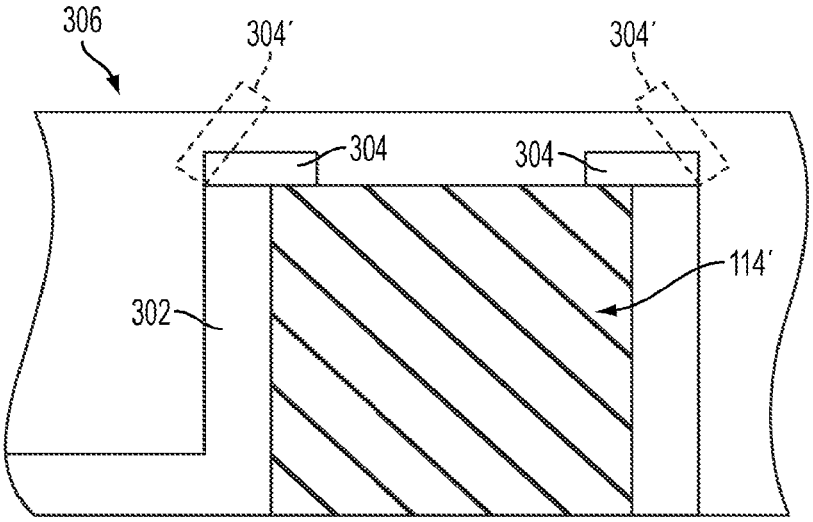
FIG. 3 is a longitudinal cross-sectional view of an isolation element having an extrusion prevention mechanism according to one aspect of the present invention.
Figure 4:
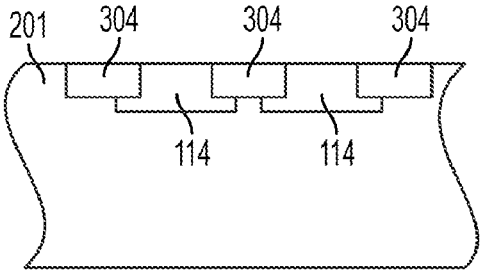
FIG. 4 is a vertical view of a joint having extrusion prevention mechanisms according to one aspect of the present invention.

FIGS. 3 and 4 depict an example of an extrusion prevention mechanism 304. FIG. 3 depicts a longitudinal cross-sectional view of an isolation element 114' having an extrusion prevention mechanism 304.

The isolation element 114' can be a swellable isolation element, such as a rubber or chemical compound that expands in response to pressure in the wellbore 102 or in response to contact with hydrocarbons from the formation 110 or contact with other fluids present in wellbore or circulated into the wellbore. The isolation element 114' can be retained by a retaining structure 302. An example of a retaining structure 302 may include multiple end rings circumferentially surrounding a joint 201 on opposite sides of the isolation element 114'.

The retaining structure 302 can include an extrusion prevention mechanism 304 that includes one or more metal protrusions overlaying the isolation element 114.' The metal protrusions can extend over the isolation element 114'. The radial expansion of the isolation element 114' can apply force to the metal protrusions. The force applied to the metal protrusions can cause the metal protrusions to extend radially, as depicted by the dashed lines of extrusion prevention mechanism 304'. The metal protrusions of the extrusion prevention mechanism 304' can contact a rigid surface 306. Examples of the rigid surface 306 can include the formation 110 or an outer casing circumferentially surrounding the joint 201. The metal protrusions of the extrusion prevention mechanism 304' contacting a rigid surface 306 can form a barrier preventing the isolation element 114' from expanding axially along the length of the joint 201.

FIG. 4 depicts a vertical view of the outer diameter of a joint 201 having extrusion prevention mechanisms 304. As depicted in FIG. 4, each of the isolation elements 114' can be overlaid by the protrusions of the extrusion prevention mechanisms 304.

The foregoing description of the aspects, including illustrated examples, of the invention has been presented only for the purpose of illustration and description and is not intended to be exhaustive or to limit the invention to the precise forms disclosed. Numerous modifications, adaptations, and uses thereof will be apparent to those skilled in the art without departing from the scope of this invention.

The invention claimed is:

1. An isolation assembly configured to be disposed in a wellbore through a fluid-producing formation, comprising:

one joint of a tubing section comprising at least two ports positioned on a perimeter of the one joint;

at least two inflow control devices, wherein each inflow control device is coupled to the one joint of the tubing section at a respective port of the at least two ports; and an isolation element positioned between the at least two inflow control devices, the isolation element being configured to fluidly isolate a first portion of the fluid-producing formation adjacent to a first respective port of the at least two ports from a second portion of the fluid-producing formation adjacent to a second respective port of the at least two ports.

2. The isolation assembly of claim 1, wherein the isolation element comprises a swellable solid material configured to expand radially.

3. The isolation assembly of claim 2, wherein the swellable solid material comprises a rubber element.

4. The isolation assembly of claim 1, wherein the isolation element comprises a chemical compound configured to expand radially in response to pressure in a wellbore in which the tubing section is disposed.

5. The isolation assembly of claim 4, wherein the chemical compound comprises an epoxy.

6. The isolation assembly of claim 1, wherein the isolation element comprises a mechanical isolation element.

7. The isolation assembly of claim 6, wherein the mechanical isolation element comprises a packer.

8. The isolation assembly of claim 1, wherein the isolation element comprises an inflatable material.

9. The isolation assembly of claim 1, wherein each inflow control device comprises an autonomous inflow control device configured to restrict a first production fluid differently from a second production fluid.

10. The isolation assembly of claim 1, wherein each inflow control device is positioned external to the tubing section at a respective port of the at least two ports.

11. The isolation assembly of claim 1, further comprising at least two filtering elements, wherein each filtering element is positioned external to the tubing section at a respective inflow control device.

12. An isolation assembly configured to be disposed in a wellbore through a fluid-producing formation, comprising:

a joint of a tubing section comprising at least two ports positioned on a perimeter of the joint;

at least two inflow control devices, wherein each inflow control device is coupled to the joint of the tubing section at a respective port;

at least two filtering elements, wherein each filtering element is coupled to the joint of the tubing section at a respective inflow control device; and an isolation element positioned between the at least two inflow control devices, the isolation element being configured to fluidly isolate a first portion of the fluid-producing formation adjacent to a first respective port of the at least two ports from a second portion of the fluid-producing formation adjacent to a second respective port of the at least two ports.

13. The isolation assembly of claim 12, wherein each filtering element comprises a wire wrap screen.

14. The isolation assembly of claim 12, wherein each filtering element comprises a mesh screen.

15. The isolation assembly of claim 12, wherein each filtering element comprises a porous medium, wherein the porous medium comprises a material having one or more pores adapted to allow a fluid to flow through the porous medium and to prevent one or more particles from flowing through the porous medium.

16. The isolation assembly of claim 12, wherein each inflow control device comprises an autonomous inflow control device configured to restrict a first production fluid differently from a second production fluid.

17. An isolation assembly configured to be disposed in a wellbore through a fluid-producing formation, comprising:

a joint of a tubing section comprising at least two ports positioned on a perimeter of the joint;

at least two autonomous inflow control devices, wherein each autonomous inflow control device is coupled to the joint of the tubing section at a respective port;

at least two filtering elements, wherein each filtering element is coupled to the joint of the tubing section at a respective inflow control device; and an isolation element positioned between the at least two autonomous inflow control devices, the isolation element being configured to fluidly isolate a first portion of the fluid-producing formation adjacent to a first respective port of the at least two ports from a second portion of the fluid-producing formation adjacent to a second respective port of the at least two ports.

18. The isolation assembly of claim 17, wherein each autonomous inflow control device is configured to restrict a flow of a first production fluid or a second production fluid through the respective port, wherein the restriction of the first production fluid is different from the restriction of the second production fluid.

19. The isolation assembly of claim 17, further comprising at least one end ring configured to prevent axial expansion of the filtering element.

20. The isolation assembly of claim 19, wherein the at least one end ring is adapted to provide a protrusion, wherein the protrusion is positioned external to the isolation element and is adapted to extend radially in response to force applied by a radial expansion of the isolation element.

* * * * *